United States Patent [19]

Kinsinger

[11] Patent Number: 4,471,185

[45] Date of Patent: Sep. 11, 1984

[54] SERIES MULTIPLE NOZZLES FOR GAS BLAST CIRCUIT INTERRUPTER

[75] Inventor: Richard E. Kinsinger, Scotia, N.Y.

[73] Assignee: General Electric Company, Schenectady, N.Y.

[21] Appl. No.: 336,757

[22] Filed: Jan. 4, 1982

[51] Int. Cl.[3] ..... H01H 33/70

[52] U.S. Cl. ..... 200/148 R; 200/148 D; 200/148 C

[58] Field of Search ..... 200/148 R

[56] References Cited

U.S. PATENT DOCUMENTS 3,842,226 10/1974 Yoon ..... 200/148 R

*Primary Examiner*—Robert S. Macon

*Attorney, Agent, or Firm*—Robert J. Jarvis; James C. Davis, Jr.; Marvin Snyder

[57] ABSTRACT

A flow nozzle for a circuit interrupter includes a plurality of at least two throat regions which permit at least two transitions from subsonic to supersonic flow in the main nozzle flow channel. Very high speed photographs made of the operation of arc interruption devices of the type considered herein have shown that the greatest amount of arc cooling occurs in transition regions between subsonic and supersonic gas blast flow. Accordingly, the ability of arc interruption devices to quickly extinguish resulting arcs between electrodes in the main flow channel is significantly enhanced by the presence of a plurality of throat regions. These throat regions may be provided by shaped constructions or by bypass collars disposed in the downstream position of the main flow channel. The instant invention is applicable both to conventional single-flow and dual-flow interrupter nozzle designs.

5 Claims, 5 Drawing Figures

SERIES MULTIPLE NOZZLES FOR GAS BLAST CIRCUIT INTERRUPTER

BACKGROUND OF THE INVENTION

The present invention relates to gas flow arc interruption devices, and, particularly, to nozzle configurations for such devices.

During the interruption of alternating current electrical circuits carrying high currents, the formation of an arc is generally used to provide a medium which can carry the high values of current near the peak of the sinusoid but convert rapidly to an effective insulating medium at times of current zero. Accordingly, a large effort has been expended over the years to design arc interruption devices which extinguish these arcs at current zero as quickly as possible. In particular, efforts have been expended in the development of gas-blast interrupters in which a pressurized blast of air, $SF_6$, or other cooling gas is blown either through or around the arc in attempts to cool the arc or to change its position or shape. Cooling of the arc is necessary to reduced the kinetic motion of the ionized arc constituents so as to promote recombination and elimination of the hot plasma gases which sustain the arc.

In a large class of arc interruption devices, electrodes are disposed along the axis of a gas-blast nozzle. In one such design, generally referred to as a single-flow design, the gas blast flows in a single direction from a region near the upstream electrode toward a downstream electrode. In another related design, generally referred to as a dual-flow design, the gas blast is introduced through ports in the side of the nozzle into a central nozzle region between two axially-disposed electrodes. In this design, the flow is outward from this central portion toward each of the electrodes. In this design, each electrode can be said to be a downstream electrode.

For both the single-flow and dual-flow designs just described, several attempts have been made to determine which axial region of a convergent-divergent gas-blast interrupter nozzle contributes most strongly to the thermal arc recovery process. In a nozzle with a high pressure ratio and small divergent angle between the downstream nozzle walls, some researchers have concluded that turbulent cooling of the arc well downstream of the nozzle throat leads to rapid thermal recovery in that region. See "Investigation on the Physical Phenomena Around Current Zero in HV Gas Blast Breaker", *IEEE Transactions on Power Applications and Systems,* Volume 95, pages 1165–1176 by D. Hermann et al., (1976).

Other design efforts in this field, participated in by the instant inventor, have indicated that, for an orifice nozzle, or a nozzle with a high divergence angle operated at a moderate pressure ratio between inlet and outlet pressures, the flow pattern includes a strong shock wave on the nozzle axis downstream of the throat. Such a shock wave produces rapid deceleration of the gas flow from supersonic velocity to subsonic velocity. When an arc is present along the nozzle axis, the shock wave interacts with the arc to broaden it. Furthermore, efforts have shown that the broadened arc downstream of the shock wave contributes very little, if anything, to the thermal arc recovery process. This conclusion is in agreement with an earlier analysis which indicated that the time constant for thermal cooling of an arc near current zero scales as arc diameter squared. See "Uber das AbKlingen von Lichtbogen. I", *Zeitschrift fur angewandte Physik,* Volume 12, pages 231–237 by G. Frind (1960).

Nozzles which are designed to operate at high upstream-to-downstream pressure ratios with a small divergence angle in the downstream section can maintain shock-free supersonic flow for relatively long distances downstream of the throat. Such nozzles may be able to derive a significant recovery speed contribution from this region. However, such nozzle designs are difficult to use in practice because the flow is easily constricted, or blocked, by either the downstream electrode (in the case of a downstream contact withdrawn through the nozzle throat during interruption) or the arc itself at high currents.

Several interrupter designs known in the art have employed two convergent-divergent nozzles in series, with the gas-blast flow directed radially inward to an upstream stagnation point on the axis between the two opposed nozzles, then in opposite axial directions through the nozzles. Gas-blast circuit breakers of this kind are described, for example, in Richter et al. U.S. Pat. No. 3,739,124, issued Jun. 12, 1973, in H. O. Noeske U.S. Pat. No. 3,739,125, issued Jun. 12, 1973, and in Tokuyama et al. U.S. Pat. No. 3,996,439, issued Dec. 7, 1976. Although such designs, commonly referred to as dual-flow interrupters, achieve two subsonic-to-supersonic flow transition points on a single arc, they still develop shock waves in their downstream nozzle sections and loose potential recovery speed from the resulting broadened arc.

SUMMARY OF THE INVENTION

In accordance with a preferred embodiment of the present invention, a flow nozzle for a circuit interrupter comprises a nozzle body having a main flow channel, the flow channel possessing at least two throat regions having locally smaller cross-sectional area, whereby a second transition from subsonic to supersonic flow in the channel is made possible. The flow nozzle of the present invention is also employable in a dual-flow configuration in which the nozzle body possesses inlet channels for directing gases from a central region of the main flow channel in opposite directions through a pair of throats in each direction. Additionally, the second throat encountered by the flow in the present invention may be provided by means of a bypass collar disposed downstream of the first throat in the main flow channel.

Accordingly, it is an object of the present invention to provide a nozzle for rapid cooling of an arc therein.

It is also an object of the present invention to provide a nozzle for a fast-acting circuit interrupter.

Lastly, it is an object of the present invention to provide a nozzle having at least two transitions from subsonic to supersonic gas flow to provide additional regions of high arc thermal recovery speed.

BRIEF DESCRIPTION OF THE FIGURES

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

DETAILED DESCRIPTION OF THE INVENTION

Figure 1:
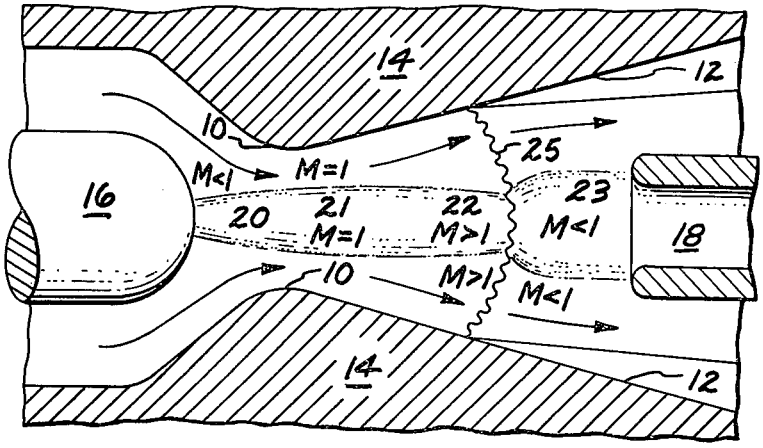
FIG. 1 PRIOR ART
FIG. 1 is a cross-sectional side elevation view illustrating a conventional single-flow nozzle design.

FIG. 1 illustrates a conventional single-flow nozzle design in which electrodes 16 and 18 are disposed along the axis of nozzle body 14. The electrodes typically comprise a metallic conductive material such as a copper-tungsten alloy. While the nozzle body 14 illustrated is indicated, by the cross hatching, to be metal, it should also be appreciated that plastic or other nonconductive materials may be employed as the nozzle body. In fact, for the designs shown, a material such as polytetrafluoroethylene (PTFE) is preferred; metal nozzle bodies are, however, employed in those designs in which the arc terminates on the nozzle body itself.

At various points in the arc or the gas-blast flow, which moves from left to right in FIG. 1, the notation "$M<1$", "$M=1$" or "$M>1$" appears to indicate that the flow in that area is typically either subsonic ($M<1$), sonic ($M=1$), or supersonic ($M>1$). Thus, in region 20 of the arc, the flow is subsonic. But, at region 21 of the arc, the flow is sonic as the arc and the gas-blast pass through throat 10. Similarly, region 22 immediately downsteam of throat 10 typically exhibits a supersonic flow. This conventional nozzle design is characterized by a downstream region in which the radius of the nozzle cross section increases with distance downstream from throat 10. This is indicated by portion 12 of the nozzle. In this design, there is a continual expansion of blast gas and a resultant drop in pressure. As a direct consequence of this structure, there develops a shock wave 25 at a particular point in the downstream flow. This shock wave is the transition boundary between a supersonic flow region 22 for the arc and a subsonic region 23. As a consequence of shock wave 25, it is seen that there occurs a wide spreading of the arc in subsonic region 23 prior to its impingement upon downstream electrode 18. As mentioned above, in this design, shock-free supersonic flow can be maintained downstream for relatively long distances from the throat by providing a high upstream-to-downstream pressure ratio together with a small divergence angle in the downstream section. However, it was pointed out above that these designs are difficult to use because of flow restriction or blockage by either the downstream electrode or the arc itself at high currents. Acccordingly, such design variations are not completely satisfactory solutions to the problems generated by the transition from subsonic to supersonic flow and the shock wave boundary.

Figure 2:
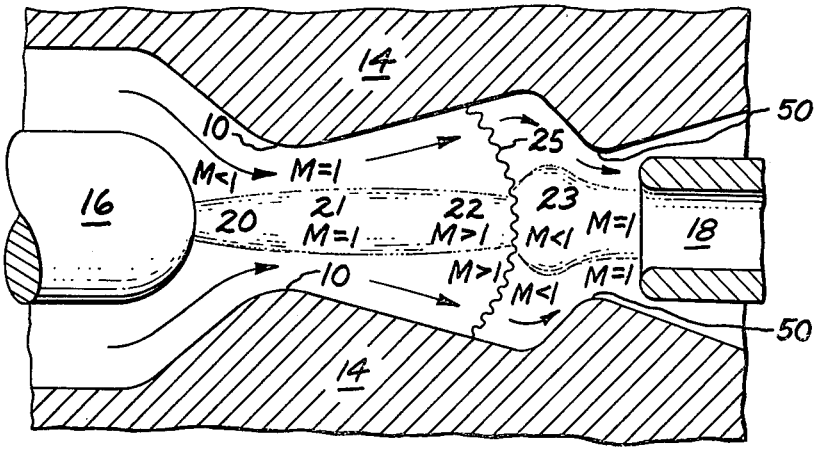
FIG. 2 is a partial cross-sectional side elevation view of a single-flow nozzle employing a second throat, in accordance with the present invention, to produce a second subsonic-to-supersonic flow transition.

However, a solution to this problem is illustrated in FIG. 2. The interrupter nozzle shown in FIG. 2 is similar to that shown in FIG. 1 except that the flow nozzle in FIG. 2 is provided with second throat 50 which constricts the flow, raises the pressure and causes a second transition from subsonic to sonic or supersonic flow prior to impingement of the arc upon electrode 18. As is seen in FIG. 2, this second throat reconstricts the widened arc downstream of shock wave 25. This results in a much more confined arc. Furthermore, as indicated above, thermodynamic analyses together with experimental evidence from very high speed photography, have indicated that arc quenching is particularly effective in the narrow, confined arc regions such as those occurring adjacent to throats 10 or 50. The temperature profiles of the arc, when so confined, make it possible to rapidly remove heat from the arc and thereby to cool the arc in a very rapid manner. This rapid cooling results in fast arc extinction during the current zero time period. In the present invention, the recovery speed is enhanced by providing more than one nozzle throat and thereby more than one region of flow acceleration from subsonic to supersonic velocity. This improvement is applicable to both single-flow and dual-flow nozzle designs. Furthermore, the interrupter in which the present nozzle is incorporated may be either the two-pressure or the puffer variety. The anticipated benefit from this design derives from experimental observations that the upstream accelerating flow and sonic flow at the throat provide most of the thermal arc recovery benefit in orifice or high downstream divergence angle nozzles. The present invention recovers some of the benefit lost in the axial region of a gas-blast arc downstream of the shock-induced transition to a broadened and poorly-recovering arc section.

Figure 3:
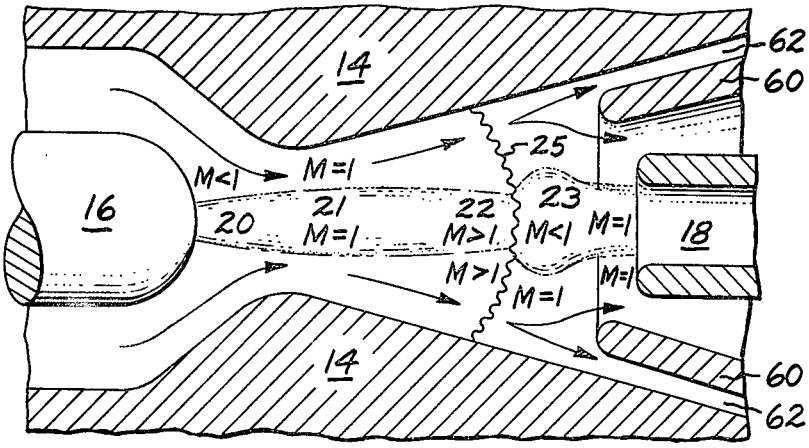
FIG. 3 is a cross-sectional side elevation view of a nozzle design, similar to FIG. 2 except that the second throat is provided by means of a bypass collar.

FIG. 3 illustrates another embodiment of the present invention in which a second throat in the downstream flow path is provided by means of bypass collar 60 which defines circumferential bypass flow path 62. The bypass collar is provided in order to relieve the effects of nozzle blocking.

In the present invention, a second throat preferably having a more locally minimum flow cross-sectional area is located downstream of the first throat. The throat is sized and positioned so as to be located downstream of axial shock waves in the interrupter. These additional throats are sized so that the gas flow, which is reduced to a subsonic speed by the shock waves, is reaccelerated to sonic velocity at the next throat and to supersonic velocity beyond the throat. Since this acceleration process and/or the near sonic flow at the throat very favorably affect the cooling of a gas-blast arc, additional accleration regions may also be provided to further enhance rapid arc recovery.

Figure 4:
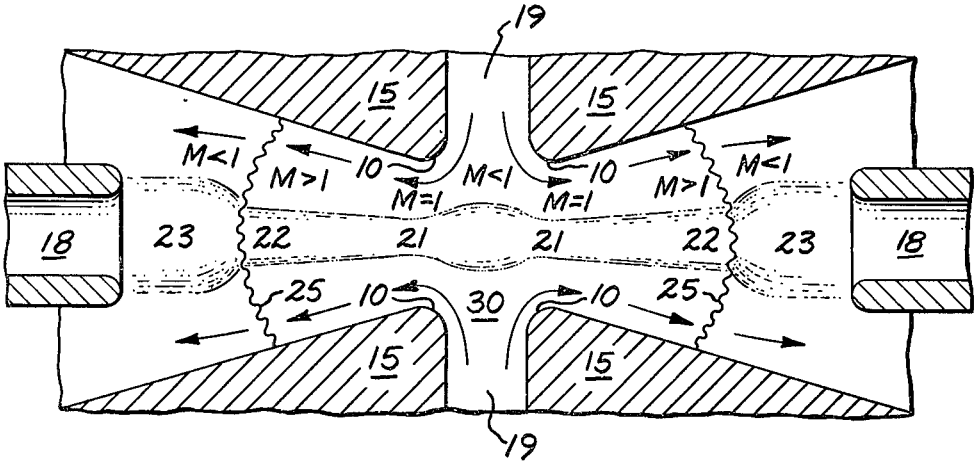
FIG. 4 PRIOR ART
FIG. 4 is a cross-sectional side elevation view illustrating a conventional dual-flow nozzle design.

FIG. 4 illustrates a conventional dual-flow nozzle design. In this design, the gas-blast is introduced into a central region 30 of the nozzle from inlet portions 19 or from gaps between two nozzle pieces. In this design, the flow is through portions 19 which are oriented approximately at right angles to the nozzle axis and the downstream flow direction in nozzle body 15. As above, electrodes 18 are disposed in a substantially axial location in the nozzle. In this design, both electrodes may be configured as "downstream" electrodes, as shown. Nonetheless, as above, following passage of the gas through first throat region 10 there can be acceleration to a supersonic velocity followed by a shock wave and transition to a subsonic velocity resulting in the undesired broadening of the arc before it impinges upon electrodes 18.

Figure 5:
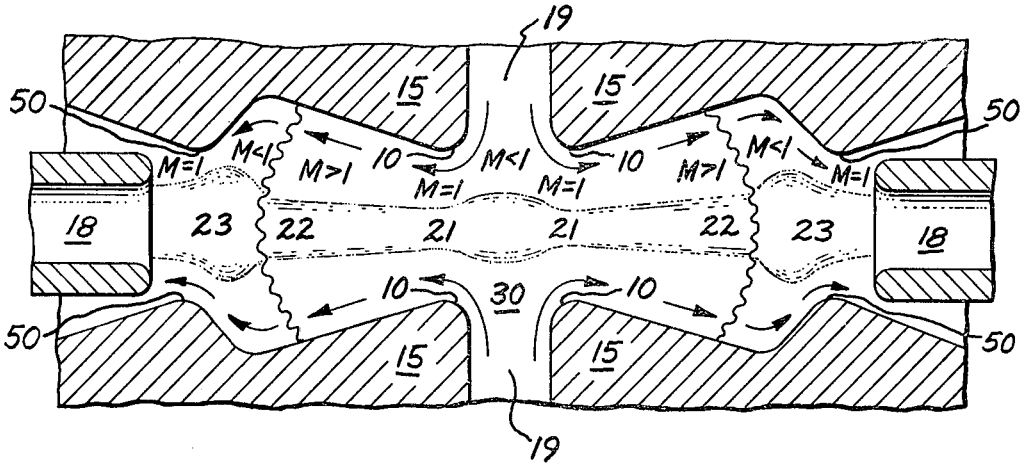
FIG. 5 is a partial cross-sectional side elevation view of a dual-flow nozzle design similar to FIG. 4 except employing multiple throats in each of two downstream nozzle portions.

However, the problem of arc broadening as shown in FIG. 4 may be readily alleviated by the employment of second nozzle throat 50 as seen in FIG. 5. Accordingly, it is seen that the present invention is applicable both to single-flow nozzle designs as illustrated in FIG. 1, and to the so-called dual-flow nozzle designs as illustrated in FIG. 4.

From the above it may be appreciated that the flow nozzle of the present invention offers significant circuit interruption advantages. In particular, the flow nozzle of the present invention provides a second transition from subsonic to supersonic flow within the main flow channel. The new flow velocity profile confines the arc to a more elongate, confined volume from which thermal energy may be removed much more rapidly. The nozzles of the present invention are easily fabricated from PTFE, other insulating material, or even metal. Furthermore, the flow nozzles of the present invention are applicable not only to single-flow but also to dual-flow circuit interrupter designs. In either of these designs, the present invention operates to more quickly cool and quench the arc.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. A flow nozzle for a circuit interrupter comprising a nozzle body having a main flow channel defined therein, said flow channel possessing at least two throat regions along any given flow direction, said regions having reduced cross-sectional flow area, with each downstream throat region being separated from the throat region located immediately upstream of said downstream throat region by a connecting passage, and with said connecting passages and said throat regions being sized and positioned so that gas flowing through each said throat region is first reducible to subsonic velocity by formation of a shock wave in each said connecting passage and then acceleratable to supersonic velocity as it passes through the next downstream throat.

2. The nozzle of claim 1 in which said nozzle body possesses at least one gas inlet passage oriented generally at right angles to said main flow channel for directing gases in opposite directions from a central region of said main flow channel, said nozzle body possessing at least four of said throat regions, with each of said oppositely-directed flow paths possessing at least two of said throat regions.

3. The nozzle of claim 1 in which said downstream throat region is provided by a flow bypass collar disposed in the downstream portion of said main flow channel.

4. The nozzle of claim 1 in which the cross-sectional area of said connecting passage increases substantially monotonically for at least a portion thereof.

5. The nozzle of claim 1 in which the cross-sectional area of each said downstream throat region is smaller than the cross-sectional area of the immediately upstream throat region.

* * * * *